United States Patent [19]

Reinhold

[11] Patent Number: 4,545,301

[45] Date of Patent: Oct. 8, 1985

[54] INK APPLICATOR FOR A TAMPON PRINTING MACHINE

[75] Inventor: Holger Reinhold, Freudenstadt, Fed. Rep. of Germany

[73] Assignee: TAMPOflex GmbH, Fed. Rep. of Germany

[21] Appl. No.: 667,459

[22] Filed: Nov. 1, 1984

[30] Foreign Application Priority Data

Nov. 3, 1983 [DE] Fed. Rep. of Germany ... 8331501[U]

[51] Int. Cl.[4] ..... B41F 17/00; B41F 31/00

[52] U.S. Cl. ..... 101/163; 101/167

[58] Field of Search ..... 101/163, 164, 165, 167, 101/150, 155, 41

[56] References Cited

U.S. PATENT DOCUMENTS 1,096,725 5/1914 Kimber ..... 101/167

2,570,756 10/1951 Bower ..... 101/41 X 4,466,348 8/1984 Buhrer ..... 101/41 X 4,491,072 1/1985 Berberich ..... 101/327

*Primary Examiner*—Clifford D. Crowder

*Attorney, Agent, or Firm*—Thomas W. Speckman

[57] ABSTRACT

An ink applicator for a tampon printing machine of the type having a printing block holder in which an ink holding pan is adjacent to the printing block and connected by an inclined surface which makes an uninterrupted transition to the top of the printing block and over which an ink distributor moves from the ink holding pan to the top of the printing block in which the ink distributor is a rotatably mounted roller which is rotatably movable from the ink holding pan up the inclined surface and across the top of the printing block in one rotatable direction and in the opposite rotatable direction return to the ink holding pan.

8 Claims, 2 Drawing Figures

INK APPLICATOR FOR A TAMPON PRINTING MACHINE

BACKGROUND OF THE INVENTION

1. Field of the Invention

This invention relates to an ink applicator for a tampon printing machine having a printing block holder, in which an ink holding pan is adjacent to the printing block, connected by an inclined surface which makes an uninterrupted transition to the top surface of the printing block, and over which an ink distributor positioned freely movable between the ink holding pan and the printing block, can be reciprocated.

2. Description of the Prior Art

In tampon printing machines which are known, ink blades or ink brushes are used as ink distributors; these draw ink, during the reciprocating movement of the ink applicator, out of the ink holding pan, onto the inclined surface, and over the surface of the printing block positioned in the printing block holder. In this known machine, the difficulty arises, during the movement of the ink applicator, in applying the ink uniformly, with the smallest crevices possible between the ink blade or the ink brush all the way to the printing block. Because of the required height differences between the ink holding pan and the top of the printing block, and the inclined surface which is necessitated by this arrangement, this uniform application is difficult to control.

In the known ink applicators which are freely movable, which are controlled only by the outflow contour, and in which the thickness of ink application is determined by the application blade, there arises an additional and undesirable abrasion of the printing block when a plastic printing block is used.

It is an objective of the present invention to design an ink distributor for an ink applicator of the types described above, which, when adjusted to the outflow contour, causes no damage to the printing block, and furthermore achieves an essentially uniform application of ink over the printing block.

SUMMARY OF THE INVENTION

According to the present invention, an ink roller is positioned in a rotatable manner as an ink distributor for the ink applicator; this roller rotates in the direction of movement of the ink applicator.

As a result of the rotational movement of the ink roller, abrasion of the printing block is reduced. The ink roller rotates up the inclined surface from the ink holding pan to the actual inking spot, the printing block, and pushes a uniform ink wedge in front of it, leaving behind a surface which has been uniformly inked. As the ink roller returns and the rotational direction is reversed, the ink is again distributed over the entire surface.

In order to obtain as small an ink wedge as possible, it is provided, in accordance with one embodiment, that the diameter of the ink roller is less than the depth of the ink holding pan. A small ink wedge can be rolled more easily, and the resulting application of ink is more uniform.

To ensure that the ink which is not utilized remains in the area of the printing block holder, one embodiment provides that the inclined surface and the top of the printing block are lower than the surface of the printing block holder, and are defined by lateral partitions.

BRIEF DESCRIPTION OF THE DRAWINGS

This invention is illustrated in the figures in which an ink applicator of the type known is contrasted with the ink applicator as specified by this invention.

DESCRIPTION OF A PREFERRED EMBODIMENT

Figure 1:
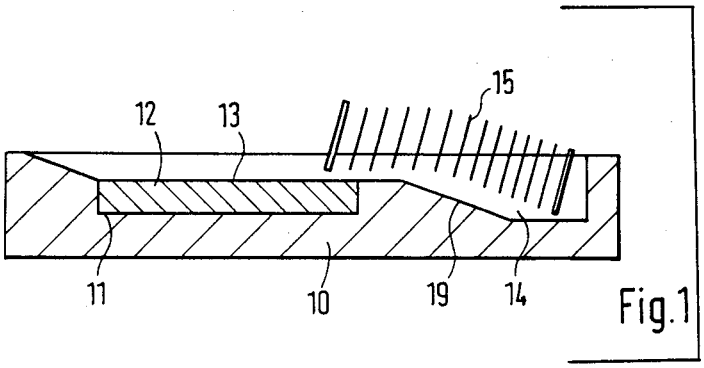
PRIOR ART Fig.1
FIG. 1 shows, schematically and in cross section, an ink applicator of the prior art type.
Figure 2:
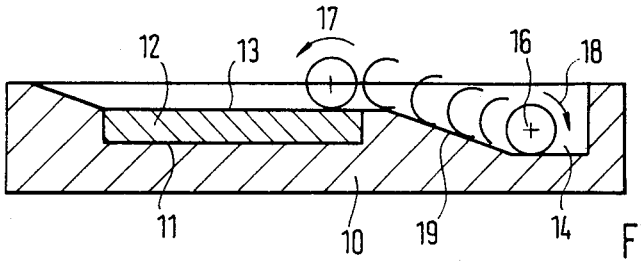
FIG. 2 shows, schematically and in cross section, the ink applicator of one embodiment of this invention.

As shown in FIGS. 1 and 2, the construction of printing block holder (10) is the same in both cases. Printing block (12) is inserted into depression (11) so that the top merges into connecting inclined surface (19), which slopes downwardly into ink holding pan (14). The outflow contour for the ink distributor formed by inclined surface (19) and the top (13) of printing block (12), is defined relative to the surface of printing block holder (10) in such a way that it can be bounded on all sides by walls of printing block holder (10). This is important because no ink should escape from printing block holder (10).

In FIG. 1, an ink brush (15) is represented schematically as the ink distributor. It can be seen clearly that it is very difficult, with ink brush (15) resting on the outflow contour, to keep the ink applied to the outflow contour evenly, which is very important for a uniform application of ink. Since the narrow crevices in the brush cannot, during the movement of the ink brush (15), be held constant, irregularities continually appear during the application of the ink, which results in an irregular printing.

If, on the other hand, ink roller (16) reciprocates as an ink distributor on the outflow contour, a rotational movement of the ink roller (16) is necessarily attained, the movement oriented in the direction of the ink application, as arrows (17, 18) show, for movement in the direction toward the printing block (12) or in the direction toward the ink holding pan (14). In this way, an ink wedge is formed in front of ink roller (16) in each direction of movement, which guarantees a uniform application of ink. Ink roller (16), which is rotatably positioned as the ink applicator, preferably has a small diameter, one which is smaller than the depth of the ink holding pan (14), so that a smaller ink wedge is formed, which can be applied significantly more efficiently. This has a positive effect on the uniformity of the ink application.

I claim:

1. An ink applicator for a tampon printing machine comprising a printing block holder (10) in which an ink holding pan (14) is adjacent to the printing block (12), connected by an inclined surface (19) which makes an uninterrupted transition to the top (13) of printing block (12) and over which an ink distributor (15) positioned freely movable between said ink holding pan and said printing block, can be reciprocated, characterized by said ink distributor being an ink roller (16) rotatably mounted, said roller (16) rotatably movable in said direction of movement of said ink distributor by contact with said inclined surface (19) and said top (13) of said printing block (12), and the diameter of said roller (16) being smaller than the depth of said ink holding pan (14).

2. An ink applicator in accordance with claim 1, characterized by said ink roller (16) comprising rubber.

3. An ink applicator in accordance with claim 2, characterized by said inclined surface (19) and the top surface (13) of said printing block (12) being lower than the surface of said printing block holder (10), and defined by lateral partitions.

4. An ink applicator in accordance with claim 1, characterized by said inclined surface (19) and the top surface (13) of said printing block (12) being lower than the surface of said printing block holder (10), and defined by lateral partitions.

5. An ink applicator in accordance with claim 1, characterized by said ink roller (16) comprising plastic.

6. An ink applicator in accordance with claim 5, characterized by said inclined surface (19) and the top surface (13) of said printing block (12) being lower than the surface of said printing block holder (10), and defined by lateral partitions.

7. An ink applicator in accordance with claim 1, characterized by said ink roller (16) comprising metal.

8. An ink applicator in accordance with claim 7, characterized by said inclined surface (19) and the top surface (13) of said printing block (12) being lower than the surface of said printing block holder (10), and defined by lateral partitions.

* * * * *